US009936818B2

(12) United States Patent
Sclare et al.

(10) Patent No.: US 9,936,818 B2
(45) **Date of Patent: *Apr. 10, 2018**

(54) MOTION DEVICE FOR CHILDREN

(71) Applicant: Kids II, Inc., Atlanta, GA (US)

(72) Inventors: Jacob Sclare, Dacula, GA (US); John Matthew Thomson, Johns Creek, GA (US)

(73) Assignee: KIDS II, INC., Atlanta, GA (US)

( * ) Notice: Subject to any disclaimer, the term of this patent is extended or adjusted under 35 U.S.C. 154(b) by 432 days.

This patent is subject to a terminal disclaimer.

(21) Appl. No.: 14/153,747

(22) Filed: Jan. 13, 2014

(65) Prior Publication Data

US 2014/0123386 A1 May 8, 2014
US 2016/0360897 A9 Dec. 15, 2016

Related U.S. Application Data

(63) Continuation of application No. 13/235,203, filed on Sep. 16, 2011, now Pat. No. 8,661,582.

(60) Provisional application No. 61/383,687, filed on Sep. 16, 2010.

(51) Int. Cl.
*A47C 9/02* (2006.01)
*A47D 9/02* (2006.01)

(52) U.S. Cl.
CPC ..... *A47D 9/02* (2013.01)

(58) Field of Classification Search
CPC .... A47D 13/10; A47C 21/006; A47C 31/003; A61G 11/008; A61G 2203/36; B62B 9/22; A61H 1/003; A61H 1/001; A61H 1/005; A61H 23/02; Y10S 297/11; Y10S 5/906; H02K 33/16
USPC ..... 5/101, 108, 109, 655
See application file for complete search history.

(56) References Cited

U.S. PATENT DOCUMENTS

| | | | | |
|---|---|---|---|---|
| 5,525,113 | A | 6/1996 | Mitchell et al. | |
| 6,339,304 | B1 | 1/2002 | Allison et al. | |
| 6,343,994 | B1 * | 2/2002 | Clarke | 472/119 |
| 6,378,940 | B1 * | 4/2002 | Longoria et al. | 297/217.3 |
| 6,793,283 | B1 * | 9/2004 | Sipos | 297/256.12 |
| 6,814,670 | B2 | 11/2004 | Morita et al. | |
| 7,203,981 | B1 * | 4/2007 | Cowgill | 5/109 |
| 7,258,617 | B2 * | 8/2007 | Chen | 472/118 |
| 7,381,138 | B2 * | 6/2008 | Dillner et al. | 472/119 |
| 7,563,170 | B2 * | 7/2009 | Bellows et al. | 472/29 |
| 7,607,734 | B2 | 10/2009 | Clapper et al. | |
| 7,727,078 | B2 | 6/2010 | Arnold, IV et al. | |
| 7,770,971 | B2 | 8/2010 | Bellows et al. | |
| 7,789,762 | B2 | 9/2010 | Greger et al. | |
| 7,824,273 | B2 * | 11/2010 | Clapper et al. | 472/95 |
| 7,874,927 | B2 | 1/2011 | Godiska | |
| 7,883,426 | B2 | 2/2011 | Bellows et al. | |
| 7,884,710 | B2 | 2/2011 | Godiska et al. | |
| 8,239,984 | B2 * | 8/2012 | Hopke et al. | 5/109 |

(Continued)

*Primary Examiner* — Eric J Kurilla
(74) *Attorney, Agent, or Firm* — Gardner Groff Greenwald & Villanueva, PC

(57) ABSTRACT

Various embodiments of the present invention are directed to a children's motion device configured to oscillate a child support about a substantially upright axis of rotation. In various embodiments, the portion of the child support configured for supporting the head of a child positioned therein is configured to remain substantially aligned with the axis of rotation as the child support oscillates.

14 Claims, 6 Drawing Sheets

(56) References Cited

U.S. PATENT DOCUMENTS

| | | | | |
|---|---|---|---|---|
| 2008/0136229 | A1 | 6/2008 | Papageorge et al. | |
| 2008/0136236 | A1* | 6/2008 | Kincaid et al. | 297/260.2 |
| 2008/0139327 | A1 | 6/2008 | Clapper et al. | |
| 2008/0146359 | A1 | 6/2008 | Godiska | |
| 2008/0146360 | A1 | 6/2008 | Godiska | |
| 2008/0146361 | A1 | 6/2008 | Godiska | |
| 2008/0165016 | A1 | 7/2008 | Godiska et al. | |
| 2008/0179928 | A1* | 7/2008 | Chen et al. | 297/260.1 |
| 2008/0217974 | A1 | 9/2008 | Velderman et al. | |
| 2008/0240483 | A1 | 10/2008 | Godiska et al. | |
| 2009/0031495 | A1* | 2/2009 | Wang et al. | 5/108 |
| 2009/0085389 | A1 | 4/2009 | Jocobs | |
| 2009/0170618 | A1 | 7/2009 | Bellows et al. | |
| 2010/0127539 | A1 | 5/2010 | Bellows et al. | |
| 2010/0151951 | A1* | 6/2010 | Gilbert et al. | 472/119 |
| 2010/0159428 | A1 | 6/2010 | Grasing et al. | |
| 2010/0201171 | A1* | 8/2010 | Velderman et al. | 297/260.2 |
| 2012/0066833 | A1* | 3/2012 | Sclare et al. | 5/101 |
| 2013/0026805 | A1* | 1/2013 | Sclare et al. | 297/260.2 |
| 2013/0154318 | A1* | 6/2013 | Van der Veer et al. | 297/216.11 |

* cited by examiner

MOTION DEVICE FOR CHILDREN

CROSS-REFERENCE TO RELATED APPLICATIONS

This patent application is a continuation of U.S. Nonprovisional application Ser. No. 13/235,203, filed Sep. 16, 2011, which application claims priority to provisional U.S. application Ser. No. 61/383,687 entitled "Motion Device for Children," which was filed on Sep. 16, 2010, both of which are herein incorporated by reference in their entirety.

BACKGROUND OF THE INVENTION

Field of the Invention

Various embodiments of the present invention described herein generally relate to children's motion devices, particularly powered motion devices configured for providing a soothing oscillating motion.

Description of Related Art

Various types of motion devices for children, such as bouncers and swings, are well known in the art. In particular, pendulum swings configured to oscillate about a substantially horizontal axis of rotation are often used to provide a calming oscillating motion for a child.

More recent art suggests a children's motion device configured to impart an oscillating motion that mimics the motion a child experiences when being held by parent or caregiver. For example, U.S. Pat. No. 7,563,170 discloses a child motion device configured to reciprocate a child seat through a partial orbit around a vertical axis of rotation. However, many children may not be soothed by this type of motion, which results in the entire child being moved along the partial orbit. In addition, the child seat of the '170 patent is driven through its partial orbit by an electromechanical drive system that makes use of various gears and shafts coupled to an electric AC or DC motor. However, the motion generated by this drive system may be noticeably less smooth than the motion a baby experiences when being held by a parent. In addition, the noise generated by this type of drive system may be unsettling to some children.

Accordingly, there is a need in the art for an improved children's motion device configured to provide a quiet, smooth, and soothing motion for a child.

BRIEF SUMMARY OF THE INVENTION

Various embodiments of the present invention are directed to a children's motion device. According to various embodiments, the children's motion device comprises a frame configured to rest on a support surface, and a child support operatively connected to the frame and configured for oscillating about a substantially upright axis of rotation. At least a portion of the child support is configured for supporting the head of a child positioned in the child support, and the child support is operatively connected to the frame such that, as the child support oscillates about its axis of rotation, the portion of the child support configured for supporting the child's head remains substantially aligned with the axis of rotation.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present inventions will now be described more fully hereinafter with reference to the accompanying drawings, in which some, but not all embodiments of the inventions are shown. Indeed, these inventions may be embodied in many different forms and should not be construed as limited to the embodiments set forth herein. Rather, these embodiments are provided so that this disclosure will satisfy applicable legal requirements. Like numbers refer to like elements throughout.

Various embodiments of the present invention are directed to a children's motion device configured to oscillate a child support about a substantially upright axis of rotation. In various embodiments, the portion of the child support configured for supporting the head of a child positioned therein is configured to remain substantially aligned with the substantially upright axis of rotation as the child support oscillates. As a result, a child positioned in the child support as it is oscillated will be swayed back and forth such that the child's legs and torso move along an arcuate path, while the child's head rotates in a substantially stationary position. In this way, the motion device mimics the motion a child experiences when a parent or caregiver cradles and sways the child. According to certain embodiments, the motion device may be configured with a drive system configured to automatically sway the child support back and forth with substantially constant amplitude of motion, thereby providing a smooth, consistent, and soothing motion for a child.

Figure 1:
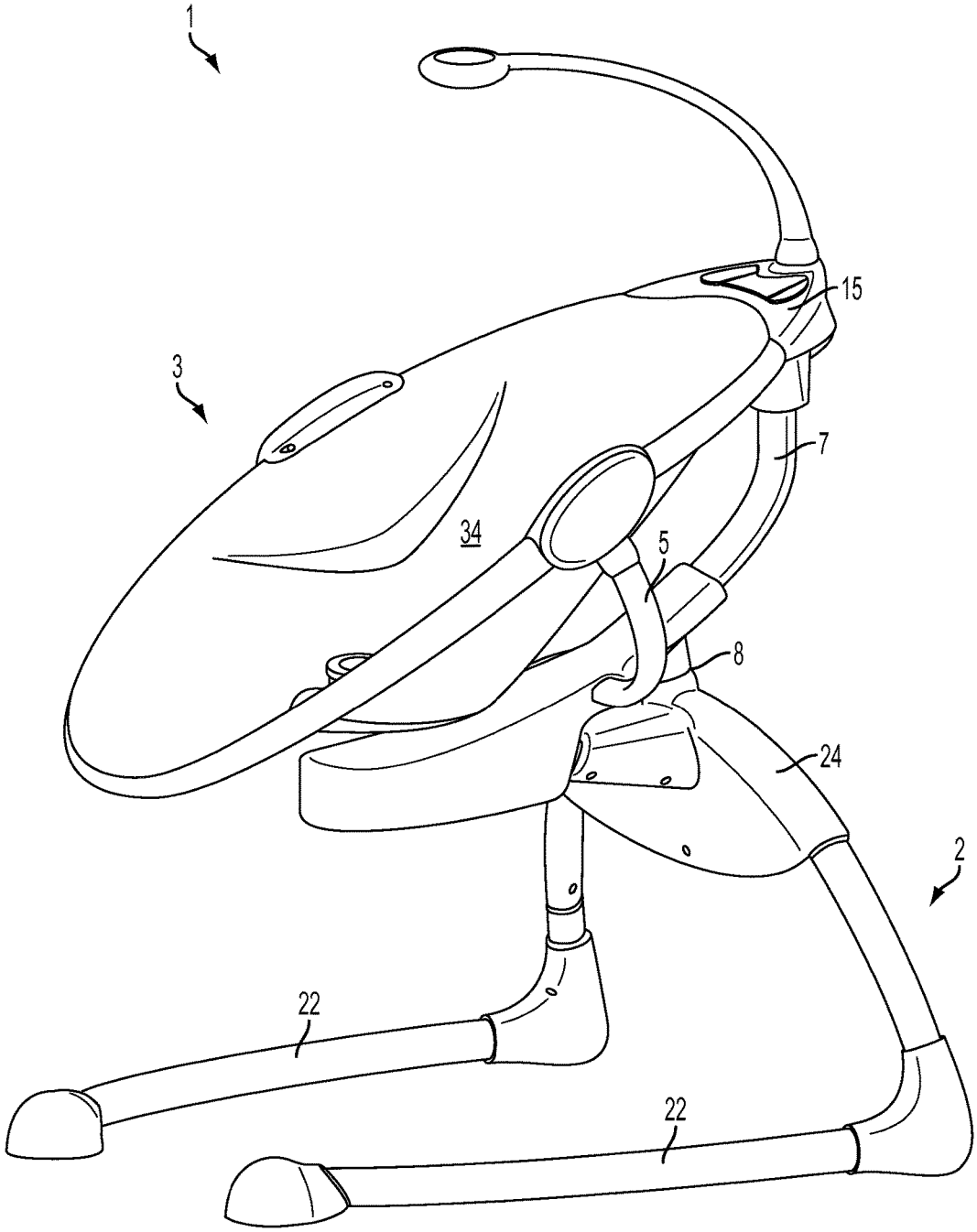
FIG. 1 shows a perspective view of a children's motion device according to one embodiment of the present invention.

FIG. 1 illustrates a powered children's motion device 1 according to one embodiment. In the illustrated embodiment, the motion device 1 generally comprises a base frame 2 and a child support 3 configured to rotate with respect to the base frame 2. As shown in FIG. 1, base frame 2 includes a pair of legs 22 having substantially horizontal portions configured for resting on a support surface and providing a stable base for the motion device 1. In addition, the legs 22 include substantially vertical portions joined by a connecting member 24. The vertical portions of the legs 22 are generally configured for elevating the remaining components of the motion device 1 above the support surface.

As explained in greater detail herein, the child support 3 is generally configured to oscillate with respect to the base frame 2 about a substantially upright axis of rotation. As shown in FIG. 1, the child support 3 is connected to a cross member 5 and a control housing 15. The cross member 5 and control housing 15 are each connected to a rotating arm 7, and are together configured to suspend the child support 3 above a portion of the rotating arm 7. The rotating arm 7 is rotatably connected to the base frame's connecting member 24 at a rotation point 8. Accordingly, the child support 3 is generally configured to oscillate with the rotating arm 7 as it rotates about the rotation point 8.

Figure 2:
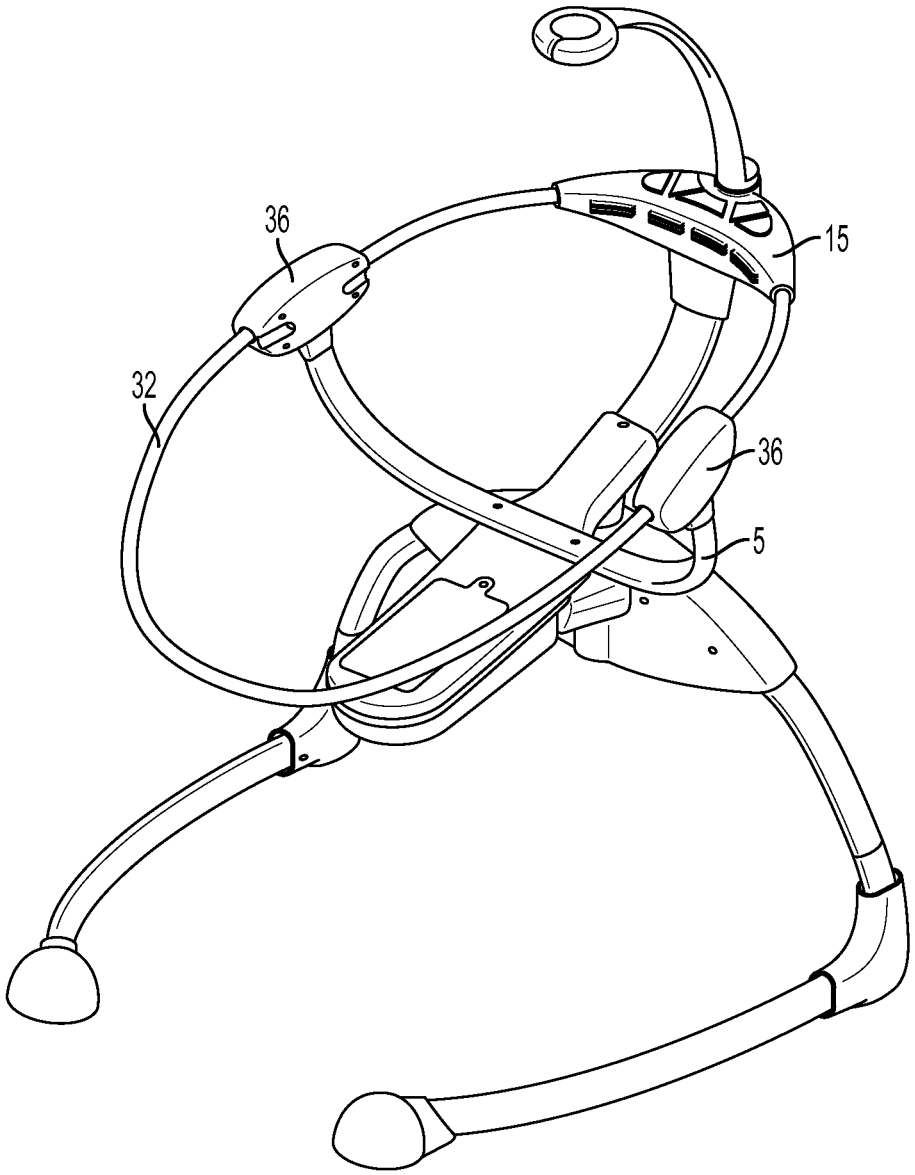
FIG. 2 shows a perspective view of a children's motion device with the fabric cover of a child support removed according to one embodiment of the present invention.

According to various embodiments, the child support 3 is generally configured for providing a comfortable, secure seating surface for a child. In the illustrated embodiment of FIGS. 1 and 2, the child support 3 comprises a fabric cover 34 (shown in FIG. 1) suspended from a plurality of support frame members 32 (shown in FIG. 2). FIG. 2 illustrates the motion device 1 with the child support's cover 34 removed. As shown, two of the support frame members 32 extend between both sides of the control housing 15 and a pair of support hubs 36. The support hubs 36 are positioned at the upper ends of the cross member 5 and are connected to one another by another support frame member 32 extending along an arcuate path between the support hubs 36. As shown in FIG. 2, the support members 32 form a generally oval perimeter from which the child support's fabric cover 34 can be suspended.

However, as will be appreciated from the description herein, the child support 3 may comprise any suitable child seating surface capable of performing as described herein. For example, in one embodiment, the child support 3 comprises a child seat having a generally rigid shell. In such an embodiment, the child support's rigid shell may be directly affixed to the support hubs 36 at lateral sides of the shell and directly affixed to the housing 15 at an upper end of the shell.

Figure 3:
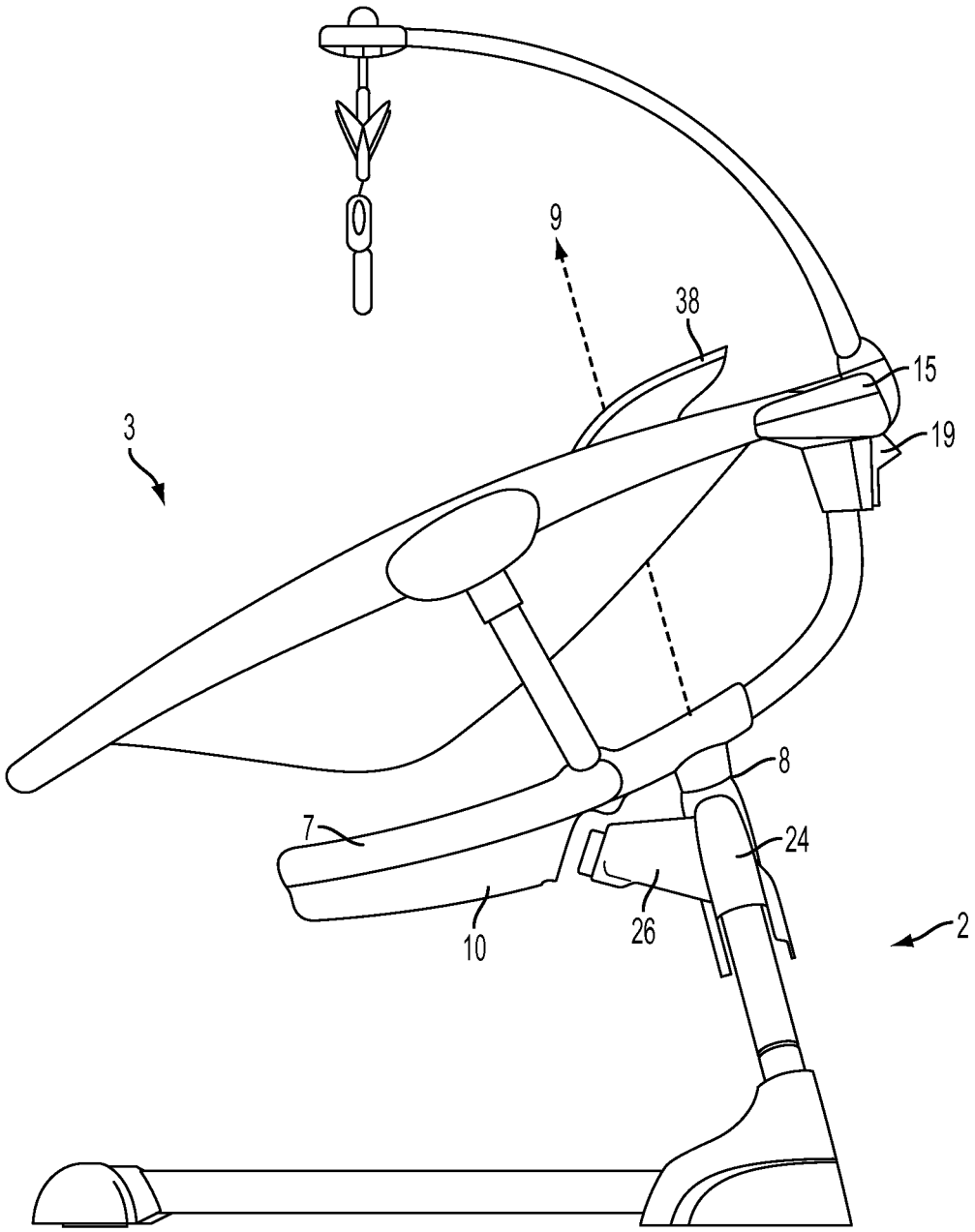
FIG. 3 shows a side elevation view of a children's motion device according to one embodiment of the present invention.

FIG. 3 shows a side view of the motion device 1 according to one embodiment. As shown in FIG. 3, the connecting member 24 includes a fixed housing 26, which extends outwardly from the connecting member 24. In addition, the rotating arm 7 includes a rotating arm housing 10, which extends downwardly from an end of the rotating arm 7 and is configured to rotate with the rotating arm 7. As explained in greater detail herein, the housings 10, 26 together house a drive system configured for oscillating the child support 3 about a substantially upright axis of rotation.

As shown in FIG. 3, the rotation point 8 is configured to enable the rotating arm 7 to rotate about a substantially upright axis of rotation 9. As can be appreciated from FIG. 3, the substantially upright axis of rotation 9 is slightly offset from vertical (e.g, offset from a vertical direction perpendicular to the support surface on which the motion device 1 rests). According to certain embodiments, the substantially upright axis of rotation 9 is offset between 5 and 25 degrees from vertical. In the illustrated embodiment of FIG. 3, the substantially upright axis of rotation 9 is offset approximately 15 degrees from vertical.

As the rotating arm 7 rotates about the axis of rotation 9, so too will the child support 3. According to various embodiments, the child support 3 is generally positioned on the motion device 1 such that the axis of rotation 9 is substantially aligned with the portion of the child support 3 configured for supporting the head of a child. As a result, when the child support 3 rotates about the axis of rotation 9, the head-supportive portion of the child support 3 will rotate, but its position will remain generally stationary with respect to the axis of rotation 9. In contrast, the portions of the child support 3 distanced from the axis of rotation 9 (e.g., the portion of the child support 3 supporting a child's feet) will move along a generally arcuate path in a plane perpendicular to the axis of rotation 9 as the child support 3 oscillates.

For example, in the illustrated embodiment of FIG. 3, the child support 3 includes a head rest pillow 38 configured to support a child's head. As shown in FIG. 3, the child support 3 is positioned such that the axis of rotation 9 extends through a portion of the head rest pillow 38. However, as will be appreciated from the description herein, it is not necessary that the axis of rotation 9 intersect the head rest pillow 38, only that the portion of the child support 3 configured for supporting a child's head—including the head rest pillow 38—remain substantially aligned with the axis of rotation 9.

Figure 4A:
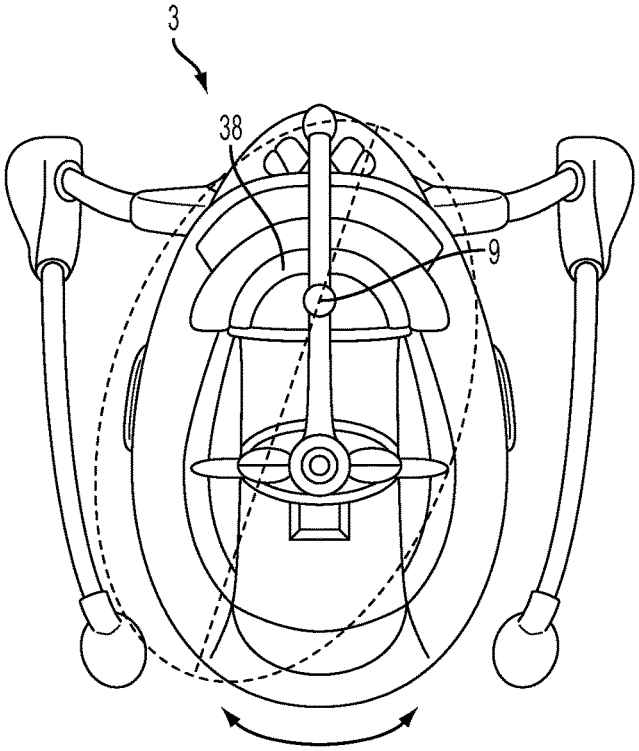
FIG. 4A shows a top plan view of a children's motion device according to one embodiment of the present invention.
Figure 4B:
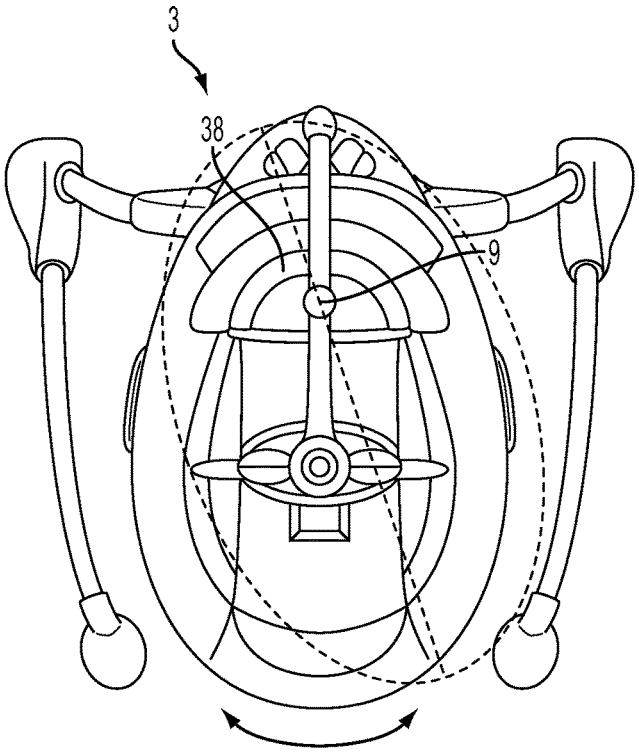
FIG. 4B shows another top plan view of a children's motion device according to one embodiment of the present invention.

FIGS. 4A and 4B illustrate a top view of the child support 3 as it oscillates about the axis of rotation 9. As will be appreciated from FIG. 4A, when the child support 3 oscillates in a clockwise direction about the axis of rotation 9, the head rest pillow 38 rotates, but its position will remain generally stationary with respect to the axis of rotation 9. In contrast, the portions of the child support 3 further from the axis of rotation 9 move some distance along a generally arcuate path. Likewise, as will be appreciated from FIG. 4B, when the child support 3 oscillates in a counter-clockwise direction about the axis of rotation 9, the headrest pillow 38 again remains in a generally fixed position while distal portions of the child support 3 move along an arcuate path.

In the illustrated embodiment of FIGS. 4A and 4B, a child positioned in the child support 3 will experience a swaying motion in which the child's feet and torso will oscillate along an arcuate path about the axis of rotation 9, while the child's head will rotate in a substantially stationary position. As noted above, this swaying motion mimics the motion a child would experience when being swayed by his or her mother. According to certain embodiments, the portion of the child support 3 configured for supporting the child's head may not include a specific head-support feature (e.g., the headrest pillow 38). For example, in such embodiments, the portion of the child support 3 configured for supporting the child's head may be the area of the child support in which a child's head would generally lie. By aligning the axis of rotation 9 with this general area, the above-described swaying motion can be achieved.

In order to provide the above-described swaying motion of the child support 3 for an extended period of time, the motion device 1 also includes an electromagnetic drive system. According to various embodiments, the electromagnetic drive system generally comprises a first magnetic component and a second magnetic component configured to generate a magnetic force that causes the child support 3 to oscillate. For example, in the illustrated embodiment of FIG. 3, the first magnetic component can be positioned in the fixed housing 26, while the second magnetic component can be positioned in the rotating arm housing 10.

Figure 5A:
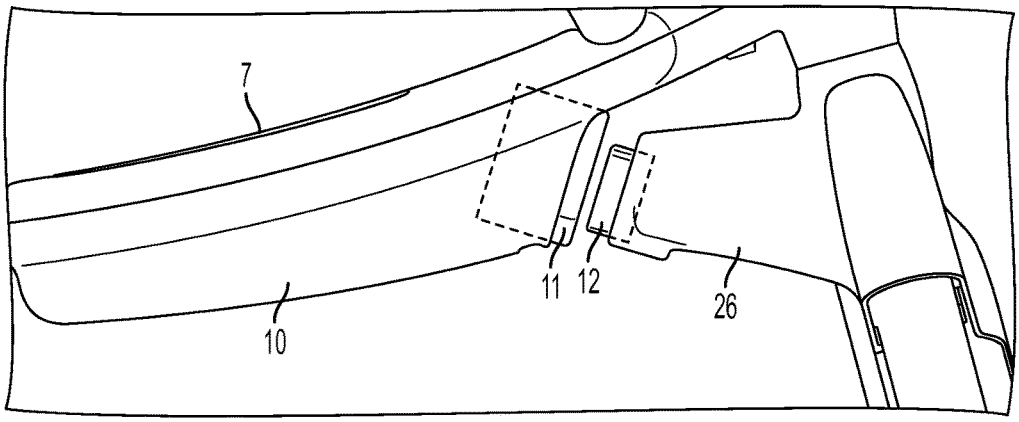
FIG. 5A shows a side elevation view of an electromagnetic drive system according to one embodiment of the present invention.
Figure 5B:
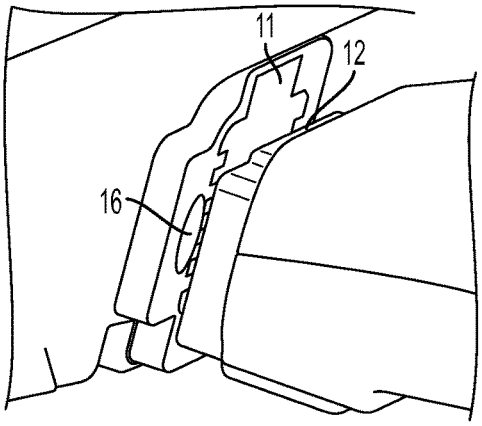
FIG. 5B shows a perspective view of an electromagnetic coil and an infrared sensor according to one embodiment of the present invention.
Figure 5C:
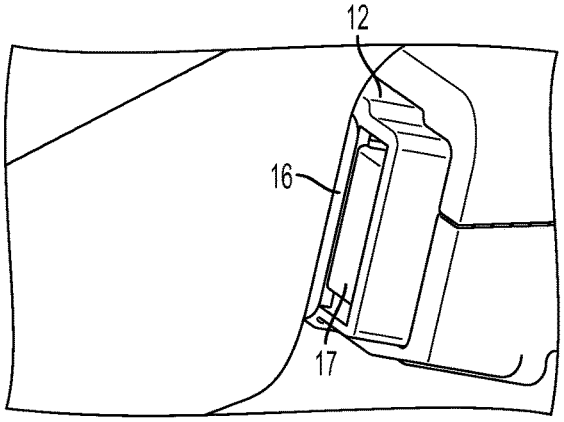
FIG. 5C shows a perspective view of a permanent magnet and a reflective strip according to one embodiment of the present invention.

FIG. 5 illustrates the motion device's electromagnetic drive system according to one embodiment. As shown in FIG. 5A, the first magnetic component comprises a permanent magnet 12 positioned in the fixed housing 26. For example, in one embodiment, the permanent magnet 12 is comprised of a ferrous magnet stacked with a neodymium magnet. The second magnetic component comprises an electromagnetic coil 11 positioned in the rotating arm housing 10. As will be appreciated from FIG. 5A, the electromagnetic coil 11 will rotate with the rotating arm 7 and child support 3 as they oscillate about the axis of rotation 9. According to various other embodiments, the first magnetic component comprises an electromagnetic coil, while the second magnetic component comprises a permanent magnet. In yet another embodiment, both the first and second magnetic components comprise an electromagnetic coil.

According to various embodiments, the electromagnetic coil 11 is configured to generate a magnetic force with the permanent magnet 12 when supplied with electric current from a power supply. In the illustrated embodiment, the electromagnetic coil 11 can be connected to a power supply (e.g., one or more batteries) also positioned the rotating arm housing 10. However, in various embodiments, the power supply may be any suitable source of electric current (e.g., a plug-in AC/DC power supply). As the direction of the electric current supplied to the electromagnetic coil 11 dictates its polarity, pulses of electric current transmitted to the coil 11 may generate magnetic forces repelling the coil 11 from the permanent magnet 12 (herein "push pulses") and/or a magnetic force attracting the coil 11 to the permanent magnet 12 (herein "pull pulses"). As the permanent magnet 12 is held in a fixed position within the fixed housing 26 and the electromagnetic coil 11 is connected to the rotating arm 7, the magnetic forces generated by the magnetic components will drive the child support 3 such that it oscillates about the axis of rotation 9. By repeatedly transmitting electric current to the electromagnetic coil 11 as it passes by the permanent magnet 12, the child support 13 can be continuously oscillated.

As described in more detail below, the amplitude of the child support's oscillation is controlled by a control circuit, which can be positioned in the rotating arm housing 10. According to various embodiments, the control circuit is configured to control the timing, direction, and width of electric current supplied to the coil 11 based on input (e.g., a feedback signal) received from a motion sensor. FIGS. 4B and 4C illustrate a motion sensor provided on the motion device 1 according to one embodiment. In the illustrated embodiment, the motion sensor comprises an infrared sensor 16 and a reflective strip 17. As shown in FIG. 4B, the infrared sensor 16 is positioned adjacent the electromagnetic coil 11 on the rotating arm housing 10, and generally faces the permanent magnet 12. As shown in FIG. 4C, the reflective strip 17 is positioned adjacent the permanent magnet 12 on the fixed housing 26, and generally faces the electromagnetic coil 11. In one embodiment, the infrared sensor 16 and reflective strip 17 are configured to generate a velocity-indicative signal (e.g., a signal having a width corresponding to the velocity of the rotating arm 7 as it passes by the reflective strip 17) that can be received and processed by the control circuit. According to various other embodiments, the motion sensor may comprise an optical sensor, Hall effect sensor, laser sensor, accelerometer, light interrupter, or other sensor suitable for generating a signal indicative of the amplitude or velocity of the child support's motion.

According to various embodiments, the control circuit is configured to receive and process feedback information from the motion sensor and control the timing, direction, and width of electric current supplied to the coil 11 in order to drive the child support 3 to oscillate at a user-preferred amplitude. For example, referring back to FIG. 1, the control housing 15 may include a plurality of user controls that enable a user to select one or more predefined oscillation amplitudes (e.g., 14-15 degrees, 17-18 degrees, 22-23 degrees). The control circuit is configured to process the user's selection and set the user-preferred amplitude as a goal amplitude. The control circuit then controls the characteristics of the electric current supplied to coil 11 based on feedback from the motion sensor in order to drive the child support 3 to continuously oscillate with an amplitude substantially equal to the goal amplitude. For example, according to various embodiments, the control circuit may be configured to control the motion device's electromagnet drive system in accordance with the methods and principles described in U.S. Publication No. 2010/0151951, the disclosure of which is herein incorporated by reference in its entirety. As will be appreciated from the description herein, the motion device's electromagnetic drive system is able to smoothly oscillate the child support 3 while generating low levels of noise (e.g., no audible noise, or a low level of audible noise).

Figure 6:
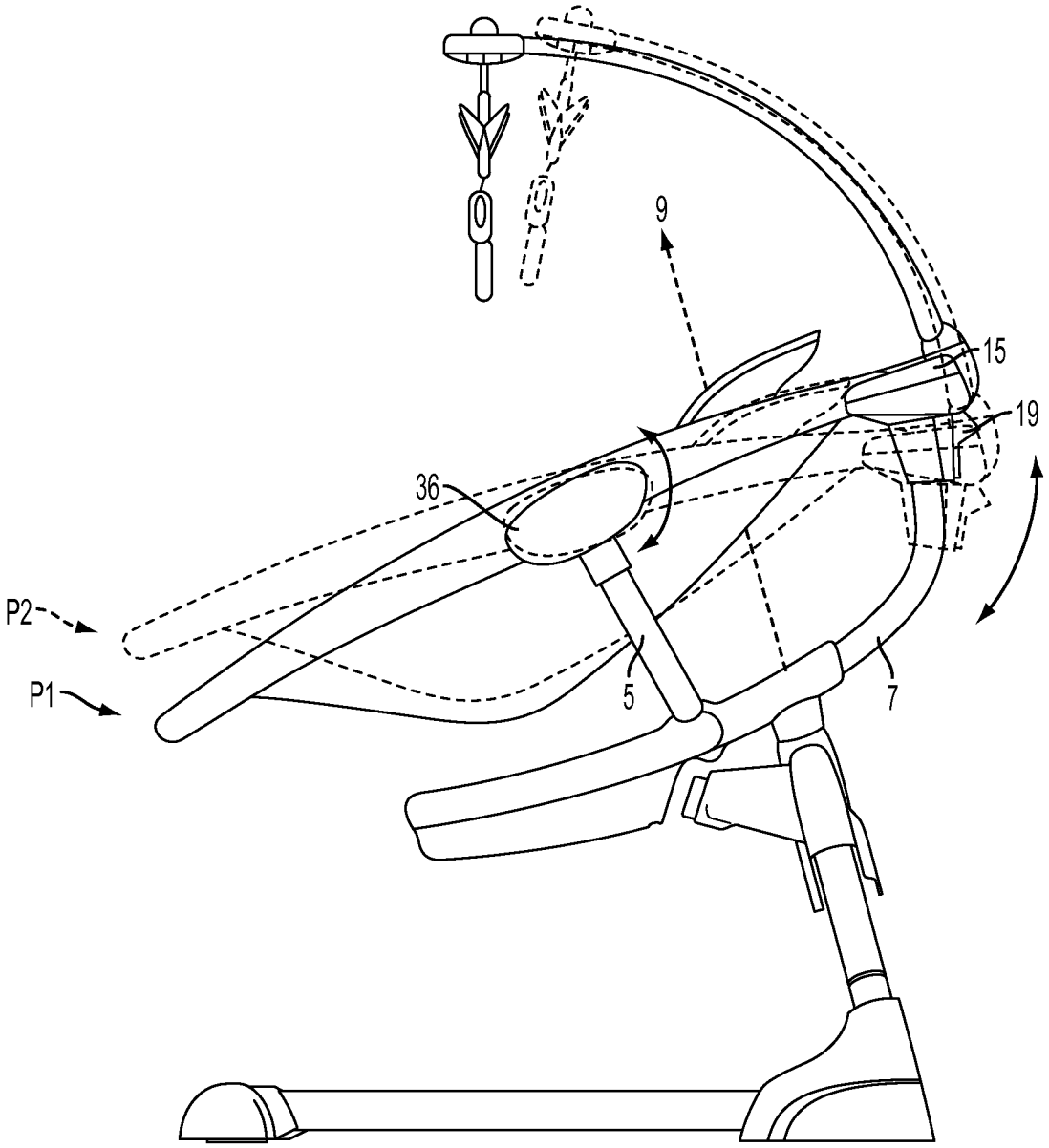
FIG. 6 shows another side elevation view of a children's motion device according to one embodiment of the present invention.

To provide further adjustability of the motion characteristics of the child support 3, the motion device 1 is configured such that the angle of the child support 3 with respect to the axis of rotation 9 can be adjusted. FIG. 6 illustrates a side view of the motion device 1 showing the child support 3 oriented in a first position P1 and a second position P2. As shown in FIG. 6, the motion device's support hubs 36 are configured to be rotatable in relation to the cross member 5, thereby permitting the angle of the support members 32 (shown in FIG. 2) with respect to the cross member 5 to be adjusted. In addition, the control housing 15 is configured to be slid along the rearward end of the rotating arm 7. For example, as shown in FIG. 6, the control housing 15 includes a release trigger 19 configured to control a locking mechanism. According to various embodiments, the locking mechanism is configured to prevent the control housing 15 from moving with respect to the rotating arm 7 when the release trigger 19 is not being pulled by a user. However, when the release trigger 19 is pulled, the locking mechanism disengages and permits the control housing 15 to be moved along the end of the rotating arm 7.

As shown in FIG. 6, the rotatable support hubs 36 and release trigger 19 enable the child support 3 to be selectively tilted with respect to the rotating arm 7. For example, FIG. 6 shows the child support 3 in a first position P1. By pulling the release trigger 19 and tilting the child support 3 such that the support hubs 36 rotate and the control housing 15 moves down the back of the rotating arm 7, a user can adjust the child support 3 to the position P2. As will be appreciated from FIG. 6, while the head-supportive portion of the child support 3 remains substantially aligned with the axis of rotation 9, the child support's angle with respect to the axis of rotation 9 is changed by adjusting the child support 3 from position P1 to P2. In effect, this tilt changes the angle of the plane along which the child support 3 will oscillate when driven about the axis of rotation 9 and thereby changes the characteristics of child support's motion. Indeed, a user may adjust the angle of the child support 3—as well as the amplitude of the child support's oscillation—in order to provide a swaying motion that is most soothing to a particular child.

The motion device 1 may include a plurality of other features to enhance the experience of a child positioned in the child support 3. For example, in one embodiment, the motion device 1 includes a user-controllable vibration unit (e.g., positioned in the control housing 15) that is configured to impart gentle vibrations to the child support 3 (e.g., vibrations in the support members 32) that can help sooth an infant. In addition, the control housing 15 may include one or more speakers configured to play various preprogrammed songs and sounds, along with a volume control device.

Further, a mobile or other child entertainment device may be affixed to the control housing 15 to provide additional entertainment for a child.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A children's motion device comprising:

a frame configured to rest on a support surface; and a child support operatively connected to the frame and configured for oscillating about a substantially upright axis of rotation;

wherein at least a portion of the child support is configured for supporting the head of a child positioned in the child support, and wherein the child support is operatively connected to the frame such that, as the child support oscillates about the axis of rotation, the portion of the child support configured for supporting the child's head remains substantially aligned with the axis of rotation.

2. The children's motion device of claim 1, further comprising at least one rotating arm rotatably connected to the frame and configured for oscillating about the axis of rotation;

wherein the child support is operatively connected to the rotating arm and configured for rotating with the rotating arm about the axis of rotation.

3. The children's motion device of claim 1, wherein the axis of rotation is offset from a vertical direction perpendicular to the support surface.

4. The children's motion device of claim 3, wherein the axis of rotation is offset between 5 and 25 degrees from the vertical direction.

5. The children's motion device of claim 1, wherein the angle of the child support with respect to the axis of rotation can be selectively adjusted by a user.

6. The children's motion device of claim 1, further comprising a drive system configured to oscillate the rotating arm and child support about the axis of rotation such that the amplitude of the child support's oscillating motion remains substantially constant.

7. The children's motion device of claim 6, wherein the drive system is an electromagnetic drive system comprising:

a first magnetic component operatively connected to the frame;

a second magnetic component operatively connected to the child support, wherein at least one of the first and second magnetic components comprises an electromagnet;

a motion sensor configured to generate a signal indicative of an amplitude of the child support's motion; and a control circuit configured to:

receive a signal from the motion sensor;

compare the signal from the motion sensor with a value indicative of a goal amplitude for the child support; and generate an electrical signal based on the comparison that causes electric current to be supplied to the electromagnet thereby generating a magnetic force between the first magnetic component and second magnetic component that causes the child support to oscillate with an amplitude nearer to the goal amplitude.

8. The children's motion device of claim 7, further comprising at least one rotating arm rotatably connected to the frame and configured for oscillating about the axis of rotation;

wherein the child support is operatively connected to the rotating arm and configured for rotating with the rotating arm about the axis of rotation; and wherein the second magnetic component is connected to the rotating arm.

9. The children's motion device of claim 7, wherein the motion sensor comprises an infrared sensor and a reflector, wherein one of the infrared sensor and reflector is operatively connected to, and configured to oscillate with, the child support, and wherein the other of the infrared sensor and reflector is operatively connected to the frame.

10. The children's motion device of claim 7, further comprising one or more user controls configured to enable a user to select from two or more predefined amplitude settings; and wherein the control circuit is further configured for defining an amplitude setting selected by the user as the goal amplitude.

11. The children's motion device of claim 1, wherein the child support comprises a support frame and a fabric cover suspended from the support frame.

12. The children's motion device of claim 1, wherein the child support comprises a child seat having a substantially rigid shell.

13. The children's motion device of claim 1, wherein the portion of the child support configured for supporting the head of a child comprises a padded head rest.

14. The children's motion device of claim 1, further comprising a user-controllable vibration device configured for transmitting vibrations through the child support.

* * * * *